United States Patent [19]

Lovell

[11] 4,168,706

[45] Sep. 25, 1979

[54] PORTABLE BREATHING SYSTEM

[76] Inventor: James C. Fletcher, Administrator of the National Aeronautics and Space Administration, with respect to an invention of John S. Lovell, Bloomfield, Conn.

[21] Appl. No.: 780,938

[22] Filed: Mar. 24, 1977

[51] Int. Cl.[2] ..... A62B 7/00

[52] U.S. Cl. ..... 128/142 R; 128/191 R; 128/212

[58] Field of Search ..... 128/191 R, 142 R, 147, 128/188, 202, 212, DIG. 14; 55/267, 388

[56] References Cited

U.S. PATENT DOCUMENTS

| | | | |
|---|---|---|---|
| 2,772,444 | 12/1956 | Burrows et al. | 128/DIG. 14 |
| 3,035,583 | 5/1962 | Hirsch et al. | 128/DIG. 14 |
| 3,566,867 | 3/1971 | Dryden | 128/188 |
| 3,669,095 | 6/1972 | Kobayashi et al. | 128/dIG. 14 |
| 3,794,030 | 2/1974 | Cotabish et al. | 128/202 |
| 3,908,649 | 9/1975 | Eckstein | 128/212 X |
| 4,005,708 | 2/1977 | Netteland et al. | 128/191 R X |
| 4,038,051 | 7/1977 | Ide | 55/269 |
| 4,048,993 | 9/1977 | Dobritz | 128/212 |

FOREIGN PATENT DOCUMENTS

| | | | |
|---|---|---|---|
| 85055 | 2/1958 | Denmark | 128/212 |
| 1259207 | 1/1968 | Fed. Rep. of Germany | 128/212 |
| 2304359 | 10/1976 | France | 128/212 |

*Primary Examiner*—Henry J. Recla

*Attorney, Agent, or Firm*—Marvin J. Marnock; John R. Manning; Marvin F. Matthews

[57] ABSTRACT

A semiclosed-loop rebreathing system is provided for use in a hostile environment. The system is characterized by a packed bed regenerative heat exchanger providing two distinct temperature-humidity zones of breathing gas with one zone providing cool, relatively dry air and the second zone providing hot, moist air. Exhaled gas is passed through the packed bed regenerative heat exchanger to increase the temperature and humidity of the gas and is then passed through a sorbent cannister containing a lithium hydroxide bed to remove carbon dioxide. The carbon dioxide-free gas is then passed through the regenerative heat exchanger in the reverse direction to cool and dehumidify the gas to normal breathing conditions. Check valves between the heat exchanger and the sorbent cannister establish gas flow in a single direction through the lithium hydroxide bed and a flexible breathing bag interposed in the flow path prevents back pressure during inhalation/exhalation sequences. A dump valve is interconnected between the heat exchanger and the inlet side of the lithium hydroxide cannister and when the breathing bag is fully extended functions to vent a portion of the exhaled gas. An external oxygen supply and control unit provides make-up oxygen to offset oxygen losses incurred by dumping a portion of the system gas and losses by metabolic consumption. A wick assembly is interconnected to the sorbent cannister at the inlet side to remove moisture condensate prior to passing the carbon-dioxide laden gas through the lithium hydroxide bed.

12 Claims, 5 Drawing Figures

FIG. 1
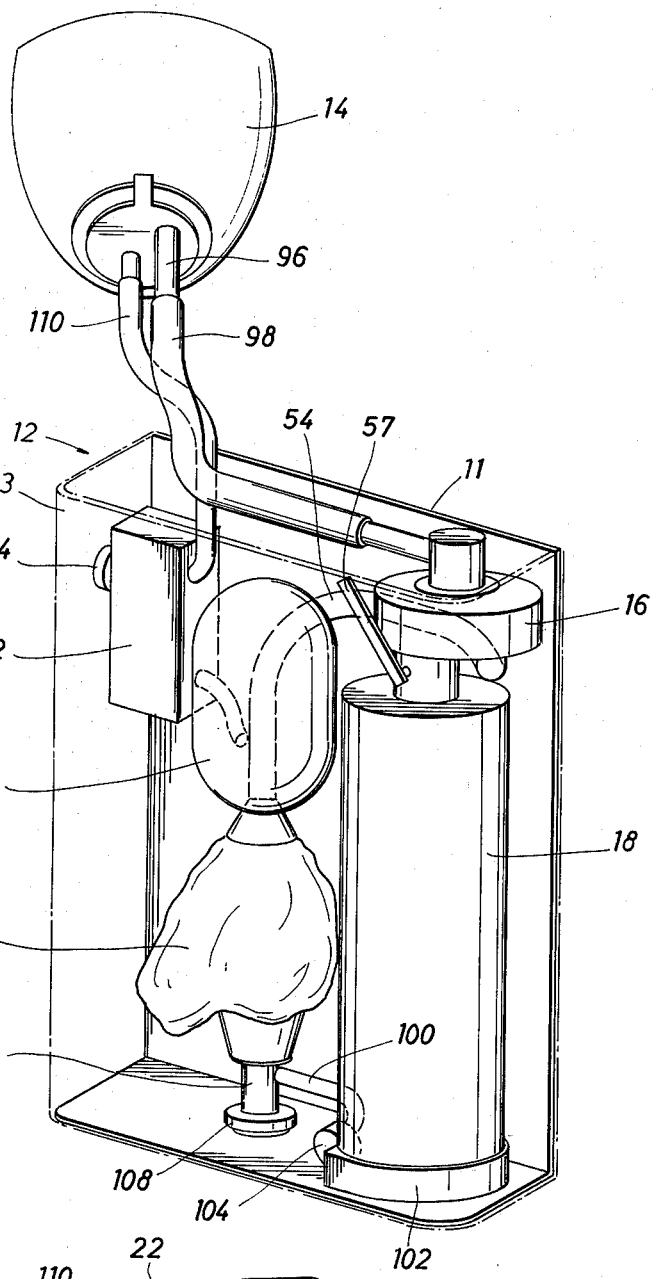
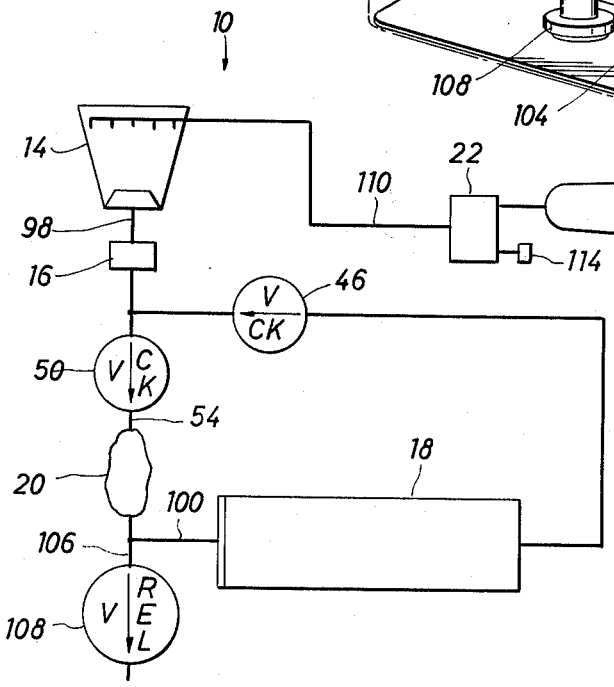
FIG. 2

PORTABLE BREATHING SYSTEM

ORIGIN OF THE INVENTION

The invention described herein was made in the performance of work under a NASA contract and is subject to the provisions of Section 305 of the National Aeronautics Space Act of 1958, Public Law 85-568 (72 Stat. 435; 45 USC 2457).

BACKGROUND OF THE INVENTION

This invention relates to methods and apparatus for providing a breathable gas mixture for use in a hostile environment and, more particularly, to a semiclosed-loop rebreather system for removing carbon dioxide and metabolically induced moisture from air exhaled by the user while further providing for radiation dissipation of heat generated during the carbon dioxide removal. While the invention will be described with particular reference to systems used by astronauts, it is to be understood that this invention is applicable to other fields which require that a breathable gas mixture be supplied to the user.

Portable breathing systems are used to enable men to perform tasks in hostile environments such as those containing noxious gases inimical to life support or in those lacking sufficient oxygen to support life. Thus, portable breathing systems find use in such varied occupational areas as space flight and fire fighting, both of which require an adequate supply of breathable gas supplied at normal breathing temperatures and humidities and free from contaminants. In recent years various such devices have been developed and in general fall into three categories.

One such category is the compressed air system consisting of a large compressed air tank feeding a demand regulator which provides a breathable gas mixture to a mask during inhalation, which exhaled air being vented out of the mask. The two major problems with this type of system are excessive total weight and short operating time, both of which may be overcome by replacing the compressed air tank with a supply hose connected to a remote source of breathing gas which, while reducing the weight of the system and increasing the operating time, has a disadvantage of restricting the user to an area defined by the length of the supply hose.

Another category is the closed-loop rebreather system, such as disclosed in U.S. Pat. No. 3,942,524, in which exhaled air is passed through a chemical bed of the superoxides, for example, potassium superoxide, which reacts with the exhaled air to remove carbon dioxide contained therein. At the same time, oxygen is released which is mixed with exhaled air and the mixture supplied to the user for rebreathing. The problem with this type of system is that the reaction of the moist warm air with the superoxide creates a slurry of melted potassium superoxide with the attendant requirement to remove the slurry prior to presenting the air for rebreathing. Additionally, the adsorption of the gas by the superoxide produces a reaction heat which must be dissipated prior to rebreathing. Thus, heat is dissipated through connection with the baffled breathing bag.

The third general category is the semiclosed-loop rebreathing system, such as disclosed in U.S. Pat. No. 3,923,053, consisting of a breathing bag, a chemical scrubber, such as a molecular sieve material for removing carbon dioxide, and an outside source of oxygen or breathing gas either in a gaseous or liquid state. Initially, the breathing bag is filled and the wearer inhales directly from the breathing bag and exhales through the carbon dioxide scrubber back into the breathing bag. The breathing gas from the outside source is slowly leaked into the bag to provide for system losses from metabolically used oxygen. The problems with such systems are the high temperature of the inhaled gas caused by the chemical reaction with the molecular sieve material and the impedance to breathing caused by the build-up of carbon dioxide in the sieve material itself. In an attempt to reduce the heat caused by reaction of moisture contained in the exhaled gas, a desiccant is interposed between the user and the scrubber.

The disadvantages of the prior art are overcome with the present invention and a portable breathing system is herein provided which is not only fully capable of providing revitalized exhaled air for rebreathing thereof, but which is also fully capable of other tasks completely beyond the capabilities of the prior art devices and systems. More particularly, however, the system of the present invention is capable of providing revitalized exhaled air for rebreathing and at temperatures and humidities normal for breathing.

SUMMARY OF THE INVENTION

In a preferred embodiment of the present invention, a semiclosed-loop rebreather system is provided which supplies revitalized breathing gas to a user, such as an astronaut in a space environment, for denitrogenization, emergency intra-vehicular activity and emergency rescue uses. While primarily designed with a space flight environment in mind, it will become readily apparent that the portable breathing system of the present invention is not limited to such use, however.

The system basically comprises a passive breathing loop having a mask connected by a duct to one port of a packed bed regenerative heat exchanger, with a second port of the heat exchanger connected through a check valve and duct into a breathing bag. The breathing bag is connected by a duct to an inlet port of a carbon dioxide sorbent cannister with the outlet port of the cannister connected through a duct and a second check valve back into the second port of the heat exchanger. Additionally, a pressure relief valve is interconnected to the duct between the breathing bag and inlet port of the sorbent cannister and provision is made to introduce oxygen into the system.

The heart of the system is the packed bed regenerative heat exchanger which is used to create two distinct humidity-temperature zones with a cool, low humidity zone interconnected to the mask and a hot, high humidity zone connected to the outlet and inlet check valves which lead to the breathing bag and the outlet port of the sorbent cannister, respectively. The packed bed of the heat exchanger is comprised of particles of a metallic material, such as small diameter aluminum shot which, when tightly packed within the heat exchanger, allows free flow of air through the heat exchanger and additionally provides a low longitudinal transfer of heat therethrough.

The sorbent cannister comprises porous, metal hydroxide pellets, having the property of chemisorbing carbon dioxide, and is placed in a hollow, cylindrical bag made of Teflon and "Nomex" nylon felt. The felt bag is placed between two perforated tubular wall members to form a cartridge which is then placed within a tubular aluminum shell having an inlet and an outlet port. The outside surface of the tubular shell is anodized black to enhance radiation produced by the chemisorption reaction. Additionally, a wick assembly is interconnected to the cannister adjacent the inlet port to entrap moisture condensate in the air exhaled by the user prior to passage through the sorbent bed.

Air exhaled by the user passes from the mask into the regenerative heat exchanger and, in passing through the heat exchanger, heat and moisture are added to the air prior to exiting therefrom. Upon exiting the heat exchanger, the hot, humid air enters the breathing bag which extends to a preselected size after which additional exhaled air opens the pressure relief valve and the additional air is vented outside the system to remove nitrogen and metabolically induced moisture introduced into the system by the user. During inhalation, air is drawn from the breathing bag through the lithium hydroxide bed, where carbon dioxide is chemisorbed, through the outlet port of the cannister and past the check valve, and into the hot zone of the heat exchanger. In passing through the heat exchanger in this direction, the air is cooled causing moisture contained therein to condense, and the air exits the heat exchanger cooled and dehumidified to normal breathing conditions. Further, during inhalation, oxygen or breathing gas is introduced into the system to make up for losses sustained through metabolic absorption of oxygen by the user and through venting of a portion of the exhaled air during exhalation.

It is therefore, a primary feature of the present invention to provide a semiclosed-loop rebreather system which supplies revitalized air for rebreathing to the user and which operates at a cool temperature and with a minimum of breathing effort.

Another feature of the present invention is to provide semiclosed-loop rereather system which operates to reduce reaction heat through radiation.

Still another feature of the present invention is to provide revitalized gas for rebreathing having a temperature and humidity consistent with the temperature and humidity of the normal breathing condition of the user.

These and other important features and advantages of the present invention will become apparent from the following detailed description wherein reference is made to the figures in the accompanying drawings showing preferred embodiments of the present invention.

BRIEF DESCRIPTION OF THE DRAWINGS

In order that the manner in which the above-recited features and advantages can be understood in detail, a more particular description of the invention may be had by reference to the specific embodiment thereof which is illustrated in the appended drawings, which drawings form a part of this specification. It is to be noted, however, that the appended drawings illustrate only a typical embodiment of the invention and therefore are not to be considered limiting of its scope for the invention may admit to other equally effective embodiments.

FIG. 1 is a pictorial representation of the semi-closed-loop portable breathing system according to the present invention and illustrating the interconnection of the several components contained therein.

FIG. 2 is a functional schematic flow diagram of the system depicted in FIG. 1.

DETAILED DESCRIPTION OF THE PREFERRED EMBODIMENTS

Figure 3:
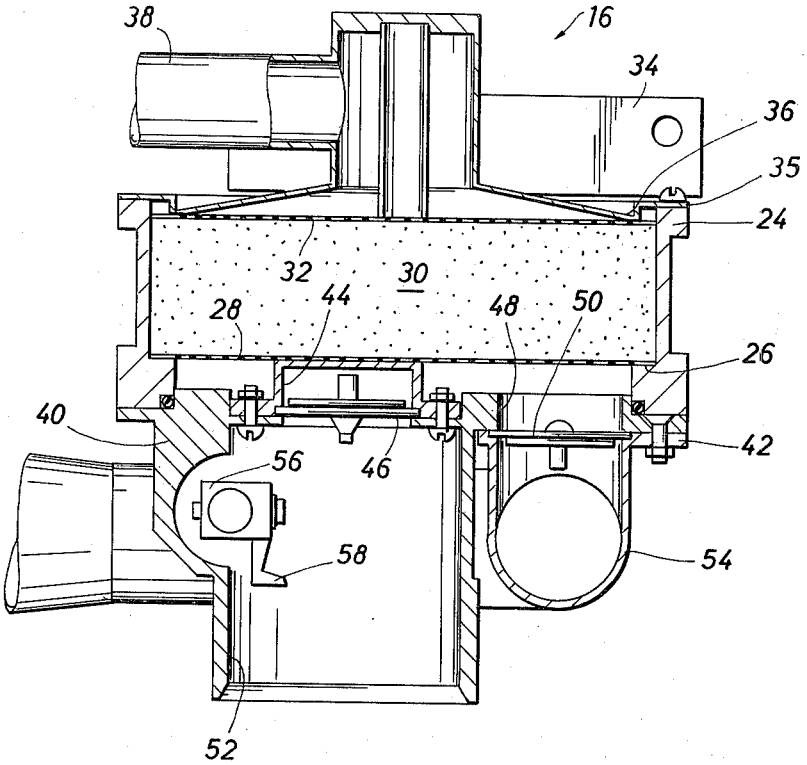
FIG. 3 is a cross-sectional view of the regenerative heat exchanger of the present invention and illustrating the check valves used to define one-way flow passage of air through the sorbent cannister.

Referring to the drawings, and in particular to FIGS. 1 and 2, there may be seen a portable breathing system, generally at 10, which may comprise a Fiberglass mounting panel 11 having aluminum angles (not shown) interconnected thereto to facilitate mounting the components of breathing system 10 thereon, and which may further comprise an aluminum cover 13 formed from a perforated aluminum plate and having access doors therein surrounding system 10. Straps (not shown) may be attached to enclosure 12 to adapt breathing system 10 to be worn as a chest pack by the user. The breathing system 10 includes a mask 14, a packed bed regenerative heat exchanger 16, a sorbent cannister 18, a flexible breathing bag 20, a vent relief valve 108, a make-up oxygen control unit 22, and a make-up oxygen bottle or source 112. As will be hereinafter described in greater detail, the components of breathing system 10 are interconnected to provide a flow path for air exhaled by the user from the mask through the regenerative heat exchanger 16 into breathing bag 20 during exhalation, and to provide a flow path for air from breathing bag 20 through sorbent cannister 18 and heat exchanger 16 into mask 14 during inhalation.

Referring now to FIG. 3 there may be seen a cross-sectional view of the regenerative heat exchanger 16 which comprises a tubular body member 24 formed from a material having low thermal transfer characteristics, such as polytetrafluroethylene. An internal shoulder 26 is formed adjacent one extremity of body member 24 and a first screen support member 28 having a diameter substantially equal to the inner diameter of body member 24 is seated against internal shoulder 26 normal to the axial center line of body member 24. Metallic material having a shape which will allow free air flow and additionally having low longitudinal thermal conductivity, such as small diameter aluminum shot, is placed in body member 24 against first support screen 28 to form a packed bed 30, with a second support screen 32 placed against bed 30 along the surface opposite support screen 28. A heat exchanger upper cover 34 having a circular disc-like portion 35 with dimensions greater than the inner diameter of tubular body member 24 closes the end of body member 24 adjacent the second support screen. A support screen retaining means 36 is formed in the circular portion 35 of upper cover 34 and engages and retains second support screen 32. A rigid tubular member 38 is interconnected to upper cover 34 to define an air flow passage from tubular member 38 through the interior of upper cover 35 to the packed bed 30.

A circular lower housing 40 having a mounting flange 42 formed on an exterior surface adjacent one extremity thereof is interconnected to body 24 with mounting flange 42 against the remaining extremity of body 24 adjacent support screen 28. Suitable mounting means, such as the nut and bolt arrangement shown in FIG. 3, is used to interconnect the upper cover 34, the tubular body member 24 and the lower housing 40 into an integral unit.

Lower housing 40 is formed to define the inlet port 44 and having an inlet port check valve 46 interconnected thereto and to define an outlet port 48 also having an outlet port check valve 50 interconnected thereto. Further, wall section 52 of lower housing 40 is extended outward from inlet port 44 to form a cannister receptacle, and outlet port 48 extends into a tubular wall member 54 which defines a duct for conveying exhaled gas. A cannister actuator 56 having an engagement hook 58 rotatable about a center pin through actuator 56 is interconnected on the interior of and adjacent one side of the wall section 52 and has the center pin extended though the wall section 52 with an actuator lever 57 (shown in FIG. 1) interconnected adjacent the exposed extremity.

Figure 4:
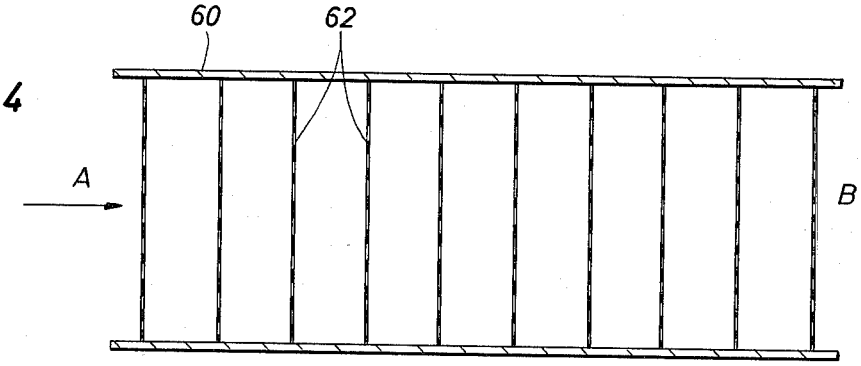
FIG. 4 is a diagrammatic representation of the regenerative heat exchanger depicted in FIG. 3 and illustrating the operation thereof.

With reference to FIG. 4, there is shown a functional schematic of the regenerative heat exchanger depicted in FIG. 3 which comprises a conduit 60 defining a flow path between A and B and having in lieu of aluminum shot a plurality of screens 62 mounted normal to the flow path and spaced throughout the length of conduit 60. As hot, moist gas introduced from the sorbent cannister into conduit 60 at extremity A, passes through screen 1, it will transfer energy in the form of heat to the screen with a resultant decrease in gas temperature. As the gas passes through each successive screen, additional heat is removed by transfer of heat to the screens until a significantly cooler gas exits conduit 60 at extremity B to the mask. As the gas passes from A to B with the resultant cooling thereof, moisture contained within the gas will condense out and remain within conduit 60 on the screens 62. When the flow is reversed, gas flowing from point B to point A will pass through the end screen 10 and acquire heat from that screen and each successive screen until its exit at point A with a temperature close to that of the hot gas initially introduced at point A. During B to A flow, the moisture entrapped within conduit 60 is reevaporated and exits with the hot gas as water vapor. A simplified explanation of the above-described operation is that as the gas passes each screen, an energy transfer occurs with the change in internal energy of the screen being substantially equal to the change in energy in the gas.

Figure 5:
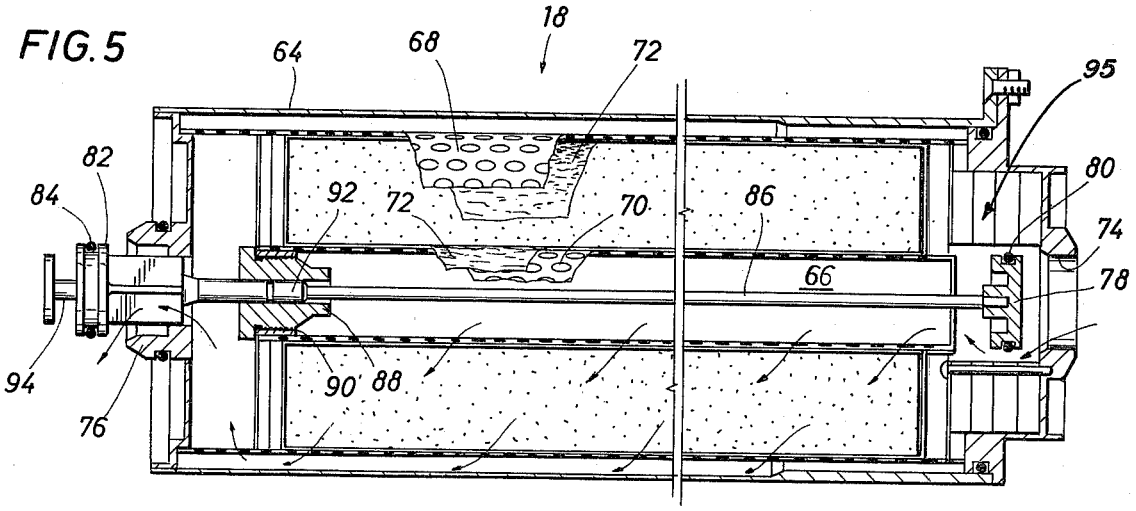
FIG. 5 is a pictorial side view of the sorbent cannister of the present invention and illustrating the inner and outer wall members for supporting the sorbent bed and further illustrating the position of the wick assembly.

In FIG. 5, there is shown a cut-away view of a sorbent cannister 18 of the present invention which comprises a cylindrical outer shell 64 having a black annodized outer coating and defining an interior chamber for supporting a lithium hydroxide cartridge 66. Cartridge 66 comprises an outer tubular member 68 formed from perforated stock having dimensions which define an annular space between shell 64 and cylinder 68 and further having an inner tubular member 70 formed of perforated stock and interconnected with outer cylinder 68 to define an annular space. A tubular filter formed from Teflon and 'Nomex' nylon felt and having first and second wall members defining an interior compartment is filled with a $CO_2$ chemisorbing porous metal hydroxide pellets, such as lithium hydroxide or the like. The lithium hydroxide charge 72 thus formed is emplaced in the annular space formed by inner and outer annular chambers 70, 68.

One extremity of shell 64 is formed to define an inlet port 74 with the remaining extremity formed to define an outlet port 76. An inlet port poppet valve 78 is provided which is dimensioned to be placed in and seal inlet port 74 and includes a sealing means 80 for providing an airtight seal between inlet port 74 and inlet port poppet 78. An outlet port poppet valve 82 is provided which is dimensioned to be placed in and seal outlet port 76 and includes a sealing means 84 for providing an airtight seal between outlet port 76 and outlet port poppet valve 82. Poppet valves 78 and 82 are interconnected by a connecting rod 86 to form a poppet valve assembly. The poppet valve assembly is placed within the interior passage formed in cartridge 66, and passed through an opening formed through cylindrical plug 88 positioned in the outlet port extremity of cartridge 66 by a threaded connection 90. During assembly, oxygen under pressure is introduced to the interior of cannister shell 64 and the poppet valve assembly is moved to the sealing position, thus entrapping the oxygen within the cannister 18 to preserve the lithium hydoxide charge 72 in an uncontaminated state until use. To ensure that the charge 72 is uncontaminated, a pressure indicator may be interconnected to the cannister 18 to provide a visual indication that the interior of cannister 18 is pressurized. A cannister actuator engagement flange 94 is formed on the exterior of outlet port poppet valve 82. Adjacent inlet port 74 and internally of cannister shell 64, a Dacron wick assembly 95 is interconnected to provide removal of water vapor condensate carried to the inlet port of cannister 18.

Referring again to FIG. 1, a rigid tube 96 extends from the interior of mask 14 with the free end interconnected to one extremity of a flexible breathing tube 98. The other end of flexible tube 98 is interconnected to the free extremity of tubular member 38 of heat exchanger upper cover 34 thereby allowing communication between the interior of mask 14 and the interior of heat exchanger 16. Outlet port 76 of sorbent cannister 18 is formed to allow positioning in sealing engagement with the inner diameter surface of wall member 52 of lower housing 40 thus placing flange 94 within proximity of cannister actuator engagement hook 58. A cannister support 102 surrounding the inlet port extremity of cannister 18 is provided to support the cannister in sealed engagement with heat exchanger 16 and defines a passage through duct 100, from inlet port 74 to the exit port of flexible breathing bag 20, thus allowing communication therebetween and with duct 54 extending from the heat exchanger outlet port 48 of lower housing 40 to the inlet port of the flexible breathing bag 20. A duct 106 is interconnected into duct 100 between breathing bag 20 and cannister support 102 and extends outward to a relief valve 108 designed to vent when the internal pressure within the duct reaches a preselected value. An oxygen duct 110 is interconnected between mask 14 and make-up oxygen control unit 22 to provide a flow path therebetween with control unit 22 providing alternative connections to a compressed oxygen bottle 112 or to an external oxygen supply through connector 114.

Referring now to FIG. 2, there is shown a schematic representation of the portable breathing system 10. Prior to operation of the system and with cannister 18 in sealed relation with heat exchanger 16, lever 57 is moved to an actuated position. This movement rotates cannister actuator 56, bringing hook 58 into engagement with flange 94 and unseating inlet and outlet port poppets 78 and 82. A flow path is defined from heat exchanger 16 through breathing bag 20, cannister 18 and back into heat exchanger 16. During operation, breathing gas exhaled by the user into mask 14 exits the mask through flexible tube 98 into the cool zone side of the packed bed regenerative heat exchanger 16. Passage through heat exchanger 16 increases the temperature and moisture content of the exhaled gas until it exits at the hot zone side of the exchanger 16 in a hot and humid condition. Check valve 46 prevents the exhaled gas from passing into the cartridge while check valve 50 allows the gas to pass into the breathing bag. When the breathing bag is extended to the full position, the pressure within the loop begins to build until a preselected value is reached at which time relief valve 108 opens to vent a portion of the hot, moist exhaled gas overboard, thus relieving the system of some carbon dioxide, metabolically induced moisture, nitrogen and heat.

During inhalation, the breathing gas remaining in breathing bag 20 is prevented from flowing into heat exchanger 16 through port 48 by check valve 50 while at the same time, the gas within the breathing bag 20 is permitted to flow through the inlet port 74 of cannister 18 into the interior chamber of cartridge 66. Air flow into cartridge 66 passes through the inner perforated wall 70 into the lithium hydroxide charge 72 which reacts to remove carbon dioxide while at the same time producing heat. The carbon dioxide-free breathing gas then passes through the outer perforated wall 68 and out of cannister 18 through outlet 76. Additional moisture condensate carried within the air flow presented to the inlet 74 of cannister 18 is trapped by wick assembly 95. Air flow from outlet port 76 passes directly through check valve 46 into the packed bed of regenerative heat exchanger 16, entering at the hot zone extremity and passing therethrough to the cold zone with subsequent reduction in temperature and condensing out of moisture contained therein, to present a revitalized breathing gas having a normal breathing condition temperature and humidity. The reaction of the lithium hydroxide in removing carbon dioxide from the breathed gas generates heat and moisture, both of which are introduced into the system breathing loop. A portion of the heat is dissipated in increasing the temperature of the hot zone extremity of the heat exchanger 16 and a portion is vented during operation of relief valve 108. However, additional means of heat dissipation must be provided to prevent raising the temperature of the hot zone of the heat exchanger to a state which will substantially raise the cool zone temperature beyond normal breathing conditions. As space flight is one of the environments envisioned for use of the breathing system, the system is designed to dissipate heat through radiation alone. This is achieved by anodizing the exterior surface of sorbent cannister 18 black to enhance radiation. Additionally, the interior of enclosure 12 in the vicinity of cannister 18 is gold coated to reduce the amount of heat absorbed by the enclosure and the aluminum cover 13 is painted black in the cannister area to aid in dissipating such heat as is absorbed.

Also during system operation, certain oxygen losses are incurred such as oxygen which is removed from the system metabolically and that which is vented during operation of relief valve 108. To offset these losses, oxygen is supplied on a make-up basis from either an oxygen bottle 112 or from the supply interconnected through oxygen supply connector 114. Control unit 22 supplies make-up oxygen through oxygen conduit 110 into mask 14 for admixing with the revitalized breathing gas supplied. Control unit 22 is designed to admit the make-up oxygen into the system only during the inhalation phase.

It will be apparent from the foregoing that many other variations and modifidations may be made in the structures and methods described herein without substantially departing from the essential concept of the present invention. Accordingly, it should be clearly understood that the forms of the invention described herein and depicted in the accompanying drawings, are exemplary only and are not intended as limitations in the scope of the present invention.

What is claimed is:

1. A portable breathing system for use in a hostile environment to provide revitalization of air exhaled by a user to permit rebreathing thereof, said portable breathing system comprising:

breather means for receiving exhaled air from the user and for presenting revitalized air to said user;

sorption means for absorbing carbon dioxide and liberating heat by exothermic reaction interconnected to said breather means for receiving said exhaled air from said breather means and revitalizing said exhaled air by removing carbon dioxide therefrom and heating said exhaled air from heat generated by the exothermic reaction between said carbon dioxide absorbing means and said exhaled air, said sorption means afterwards discharging said revitalized air into said breather means; and regenerator heat exchanger means interposed between said sorption means and said breather means for heating and humidifying said exhaled air prior to receipt thereof by said sorption means and for cooling and dehumidifying said revitalized air to normal breathing conditions prior to discharge thereof into said breather means.

2. The system described in claim 1 and further including:

moisture removal means interposed between said regenerator means and said sorption means for removing moisture from said heated and humidified exhaled air prior to receipt by said sorption means.

3. The system described in claim 1 and further including:

first check valve means interposed between said regenerator means and said sorption means and interconnected to allow said exhaled air to flow from said regenerator means to said sorption means and to prevent said exhaled air from flowing directly to said sorption means from said regenerator means; and second check valve means interposed between said sorption means and said regenerator means and interconnected to allow said revitalized air to flow from said sorption means to said regenerator.

4. The system described in claim 1 and further including:

a flexible breathing bag interconnected between said regenerator means and said sorption means and operative to receive said exhaled air during exhalation by said user and to discharge said exhaled air into said sorption means during inhalation by said user.

5. The system described in claim 1, wherein said regenerator means further comprises heat exchanger means for increasing the temperature and humidity of exhaled air flowing through said regenerator means and for decreasing the temperature and humidity of revitalized air flowing through said regenerator.

6. The system described in claim 5, wherein said regenerator means comprises:

a body member defining on interior compartment and further defining a first part adapted to be connected to a first flow line for receiving exhalations from a user, a second port establishing a flow path through said interior compartment and said first port, a heat exchange bed in said compartment to effect a transfer of heat between said bed and said air;

means in said interior compartment for supporting said bed, second flow line means connected to said regenerated means for delivering heated and humidified exhaled air from said second port of the regenerator means to said sorption means, said interior compartment having a third port establishing a flow path through said compartment from said third port to said first port, third flow line means connected to said sorption means for delivering revitalized carbon dioxide free air from said sorption means to said regenerator means.

7. The system described in claim 6, said bed comprising a plurality of spherical particles of aluminum.

8. The system described in claim 1, wherein said sorption means comprises:

a body member having an air passage therethrough and sorbent means therein for interacting with said exhaled air to remove carbon dioxide therefrom; and moisture removal means associated with said body member for removing and retaining moisture from said exhaled air.

9. The system described in claim 8, wherein said body member is formed of black anodized aluminum for transferring heat from said body member in order to cool said body member.

10. The system described in claim 8, wherein said sorbent means is a metallic hydroxide.

11. The system described in claim 8, wherein said sorbent means is lithium hydroxide.

12. The system described in claim 8, and further including valve means interposed in said passage and movable from a first position for sealing said passage means to a second position for allowing said air stream to flow through said passage means to effect carbon dioxide and moisture removal from said air stream.

* * * * *